United States Patent [19]

Guzowski et al.

[11] 3,947,265

[45] Mar. 30, 1976

[54] PROCESS OF ADDING ALLOY INGREDIENTS TO MOLTEN METAL

[75] Inventors: Matthew M. Guzowski, Wallingford, Conn.; E. Dennis Bishop, Pittsburgh, Pa.; William C. Setzer, Hamden, Conn.

[73] Assignee: Swiss Aluminium Limited, Chippis, Switzerland

[22] Filed: Oct. 23, 1973

[21] Appl. No.: 408,500

[52] U.S. Cl. ..... 75/10 R; 75/129; 75/135

[51] Int. Cl.[2] ..... C22B 4/06; C22C 1/00

[58] Field of Search ..... 75/10, 129, 135; 148/26; 164/50, 52, 250, 252

[56] References Cited

UNITED STATES PATENTS

| | | | |
|---|---|---|---|
| 3,342,250 | 9/1967 | Treppschuh | 75/10 R |
| 3,344,839 | 10/1967 | Sunnen | 75/10 R |
| 3,507,968 | 4/1970 | Parsons | 75/10 R |
| 3,625,757 | 12/1971 | Wiehe | 148/26 |
| 3,729,309 | 4/1973 | Kawawa | 75/53 |
| 3,768,999 | 10/1973 | Ohkubo | 75/58 |

*Primary Examiner*—Peter D. Rosenberg
*Attorney, Agent, or Firm*—Robert H. Bachman

[57] ABSTRACT

A process and an apparatus for making alloying additions to molten metals. The process consists of providing the material to be added in the form of strip, wire or rod: placing this material in close proximity to the molten metal to which the addition is to be made; and flowing a high current through the material to be added and the molten metal forming an arc between the molten metal and the material to be added. The heat of the arc melts the addition material which is then driven through the arc into the molten metal.

11 Claims, 6 Drawing Figures

PROCESS OF ADDING ALLOY INGREDIENTS TO MOLTEN METAL

BACKGROUND OF THE INVENTION

The addition of alloying elements to a pure metal is commonly done in order that improved properties may be obtained. In almost all situations the material to which the addition is to be made is molten and the material to be added is added in the form of solid metal. This addition technique has limitations, as difficulties are encountered where the solubility of the addition material in the base material is limited, and where the melting point of the addition material is significantly higher than the melting point of the base metal. If either of these situations exists, it is difficult to consistently make homogeneous alloys of the desired composition. Further difficulties sometimes are encountered including the situation where the melting point of the material to be added is significantly lower than the melting point of the base metal, in which case volatilization of the material being added can result, and the situation where the material being added has a deleterious reaction with the furnace or crucible which contains the base metal, in which case, contamination of subsequent melts may occur. For the preceding reasons it would be extremely desirable to have a method available for the addition of alloying elements to molten materials which would be largely unaffected by the relative melting points, solubilities and chemical activities of the materials involved.

SUMMARY OF THE INVENTION

The process of the present invention consists of using a high current arc, formed between the molten base metal and the alloying addition, to melt and superheat the alloying addition, thereby placing it in condition to rapidly dissolve in the base metal. A desirable embodiment of the invention consists of using the process of the invention to make alloying additions during continuous casting. In this fashion, changes in composition may be made as the casting process proceeds.

Accordingly, it is an object of the present invention to provide a process for making alloying additions to molten metals.

It is another object of this invention to provide a process wherein the alloying material is melted and superheated prior to being added to the molten metal.

It is a further object of this invention to provide a process in which the rate of alloying must be controlled during a continuous casting process. Other objects and advantages will become apparent from the following description and drawings.

DESCRIPTION OF THE DRAWINGS

FIGS. 2, 3 and 4 show this information for aluminum, iron and magnesium respectfully.

DESCRIPTION OF THE PREFERRED EMBODIMENTS

Figure 1:
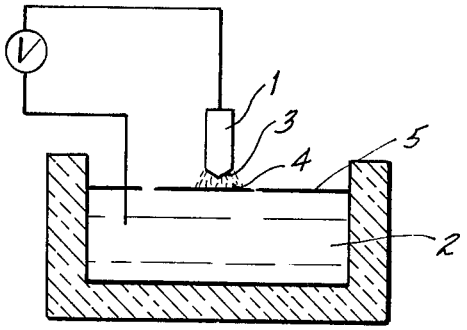
FIG. 1 shows the basic embodiment of the invention, the use of an electrical arc to vaporize the alloying addition prior to its addition to molten metal.

Great difficulty has heretofore been encountered when alloying additions are made to molten metals. These difficulties are particularly severe when the melting point of the alloying addition is significantly higher than the melting point of the base metal.

If the melting point of the alloying addition exceeds the melting point of the base metal, the temperature of the base metal must usually be increased if the alloying addition is to be placed in solution. This is particularly true if the solubility of the alloying addition in the base metal is limited. In many situations it is impossible to increase the temperature of the base metal above the melting temperature of the alloying addition since the base metal will boil or vaporize before the desired temperature is reached. For example, the solubility of zirconium in aluminum is extremely limited and this fact combined with the difference in melting points makes the addition of zirconium to aluminum alloys a difficult task. Even if the zirconium were to be added in molten form, difficulties would be encountered since the molten aluminum would serve to cool the molten zirconium to below solidification temperature. Apart from situations where it is difficult under any circumstances to make alloying additions, there are several situations where it would be highly desirable to have a method of making extremely rapid additions of alloying elements. For example, in certain alloys it is desirable to add a highly reactive element such as titanium, aluminum, zirconium, boron or phosphorous as a deoxidizing element immediately prior to casting the material. It is desirable from both economic and technical view points that the deoxidizing additions be kept to a minimum and that the subsequent exposure of the melt to air be kept to a minimum. However, if these additions are made in the furnace prior to casting, an excess must be added in order to compensate for oxygen which may be picked up prior to solidification. This problem might largely be solved if the alloying addition could be made to the metal as the molten metal flowed from the furnace to the casting mold. A similar set of considerations governs the addition of grain refining elements to certain types of alloys. These grain refining additions have a tendency to settle to the bottom of the molten metal and consequently an excess addition must be made. This necessity could be eliminated and a more homogeneous casting would result if the alloying addition could be made to the molten metal as it flowed to the casting mold. A similar problem that occurs when two alloying elements tend to form a co-precipitate in the melt may also be obviated. Other situations where it would be desirable to make alloying additions immediately before the metal entered the mold, include situations where the material being added might react with or contaminate the furnace lining material or where the material being added might be so volatile or reactive that excessive losses would occur if it were added to the furnace.

The invention disclosed in this application largely overcomes the problems noted in the preceding paragraph. In accordance with the invention of the present application alloying elements are added to the molten base metal in a molten superheated state. In the preferred embodiments of the invention the alloying elements are added in a finely divided condition having a particle size of less than 100 microns. This fine particle size leads to greatly increased surface area and thereby increases the rate at which the alloying element goes into solution.

The invention will be better understood through reference to the following drawings. FIG. 1 shows a preferred embodiment of the invention. The material 1 to be added to the base metal, 2, is provided in elongated form, wire, rod, tube or strip. A free end 3 of the alloying element 1 is placed in close proximity to the surface of the molten metal 2. The exact distance between the free end 3 and the surface of the molten metal will be determined by the electrical parameters and the metals involved. A voltage V is applied between the surface of the molten metal and the alloying element. The high intensity, high temperature electric arc 4 which results between the end 3 of the alloying element 1 and the surface 5 of the molten metal 2 serves to melt the alloying element 1 and transfer the alloying element 1 into the molten metal 2. This arc 4 may be initiated by briefly touching the end 3, of the alloying element 1 to the molten metal 2 and then withdrawing it. The return electrical connection between V and the molten metal 2 may be provided by immersing a conductor, inert to the molten metal, in the molten metal.

Figure 2:
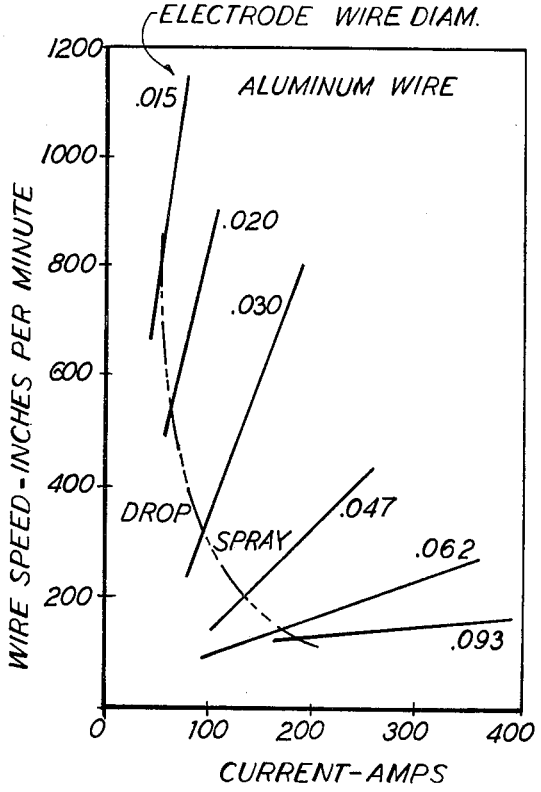
FIGS. 2, 3 and 4 show information concerning the effect of current density on the transfer of molten metal through an electrical arc.
Figure 3:
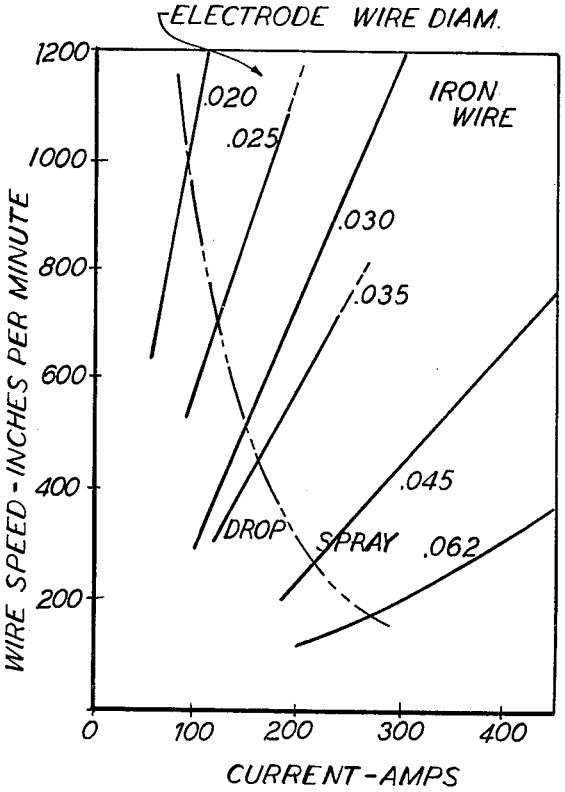
Figure 4:
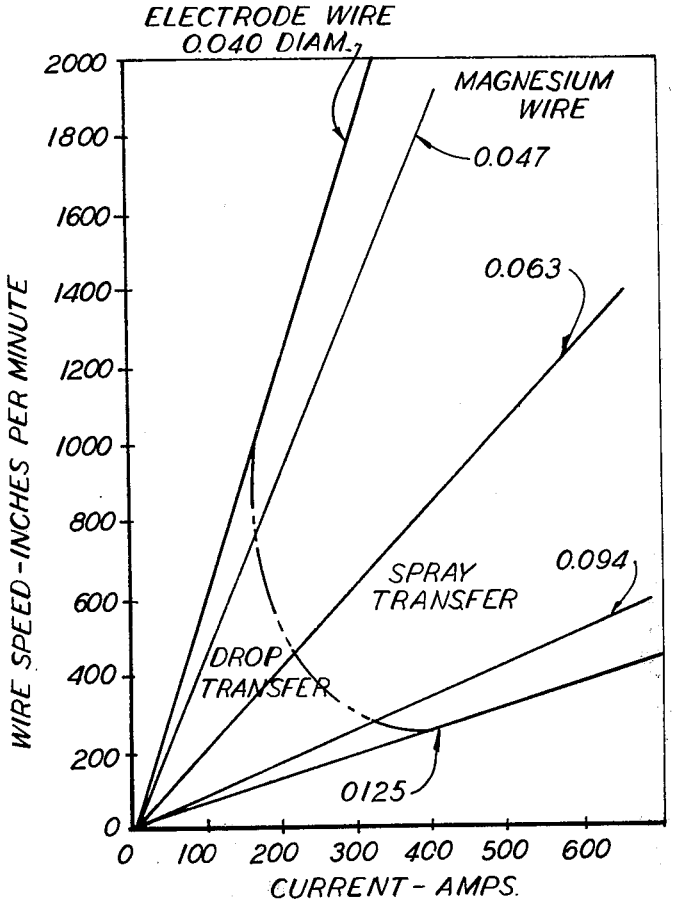

Metal transfer across an electric arc may occur in at least two different ways. At lower current densities, the material being transferred across the arc melts, forms large drops, and these drops are transferred across the arc. As the current density is increased the transfer mechanism changes and the metal being transferred moves through the arc in the form of a spray of finely divided molten particles. Typically, the size of the particles is less than 100 microns. The current density at which the transition from drop transfer to spray transfer occurs varies with the materials and the size of the wire from which the metals is being transferred. FIGS. 2, 3 and 4 show information of this type for aluminum, iron and magnesium alloys for a variety of wire sizes. In general, the transition from drop to spray occurs at a current density of between 100,000 and 150,000 amperes/sq.in. It is highly desirable that the current density be in excess of 100,000 amperes/sq.in. of alloying addition.

Figure 5:
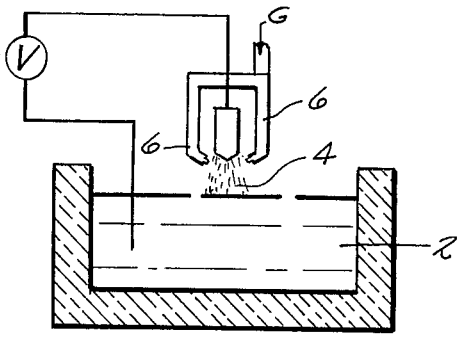
FIG. 5 shows the use of a protective gas to shield the material in the arc from contamination by the atmosphere.

FIG. 5 shows a more complete embodiment of the present invention showing the addition of an inert shielding gas G through nozzles 6, 6 to protect the finely divided element in the arc 4 from oxidation by contacting the air.

Figure 6:
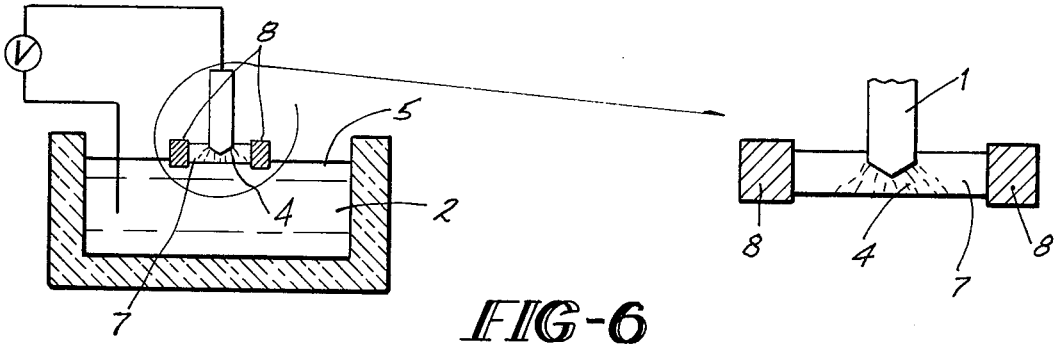
FIG. 6 shows the use of a flux to protect the arc from contact with the atmosphere.

Of course, other methods may be used to shield the material from the arc from deleterious gases. One such shielding method consists of providing an alloying addition wire having a layer of decomposable material on its outer surface. As this material enters the arc it decomposes, yielding a suitable shielding atmosphere. Another alternative, which is shown in FIG. 6, would be to provide a suitable flux 7 material on the surface 5 of the molten metal 2. This material 7 could be confined to a small area by placing it within a restraining ring 8 made up of an inert material which would float upon the surface 5 of the molten material 2. In practice, the arc 4 would occur wholly within this flux material 7 and would therefore not be affected by gases in the atmosphere. This embodiment would be useful if toxic elements such as arsenic were to be added since losses to the atmosphere would be eliminated.

As was mentioned above, it is preferred that the current density in the arc exceed 100,000 amperes/sq.in. cross-sectional area of the alloying addition. The voltage across the arc will necessarily vary with the cross-sectional area of the alloying addition and the materials involved. However, it will generally fall within the range of 15 to 30 volts. It is preferred that the polarity of the applied voltage be such that the alloying element is positive relative to the molten material. If this polarity is observed, an increased melting rate of the alloying addition will be obtained. However, this polarity is not critical and the process may readily be carried out using a D.C. arc of opposite polarity or an A.C. arc.

It is preferred that the source of the current generating the arc be of a so called constant voltage type, that is one in which the set voltage remains relatively constant regardless of current fluctuations. If this type of source is used the arc will have a self-stabilizing characteristic and will be relatively insensitive to changes in arc length caused by fluctuations in the molten metal level.

It may be desirable to add a high frequency, high voltage component to the arc. This component is particularly useful if an A.C. current is used, in that it reduces the tendency of the arc to extinguish everytime the voltage passes through zero, but serves in all situations to increase the stability of the arc and to make initiation of the arc less difficult. The frequency of the high frequency component will preferably be from 5 to 50 KHz and the voltage will be from 10 to 200 volts.

The process of the present invention is particularly useful in the addition of alloying elements to molten metal as the molten metal flows from the melting furnace into a casting mold. A particular application of this type in which the process of the present invention has high utility is in a continuous casting of metal bars or slabs. In this application it is a straightforward matter to calculate the desired feed rate, since the casting process proceeds at a uniform rate. However, the process may be rendered even more versatile by the addition of some type of sensing device to sense the flow rate of the molten base metal and to make adjustments in the alloying material feed rate. In this fashion the alloying process could continue unattended even though the cross-sectional area or drop rate of the continuous casting were to be changed.

In a practical application the alloying addition must be made far enough upstream from the casting mold so that the material added has sufficient time to become thoroughly mixed with the base metal. It may be desirable for a variety of reasons to have more than one alloying addition made to the flowing molten metal. For example, if the width of the flowing metal is great relative to its depth a more homogeneous product will result if two laterally spaced additions are made to the flowing stream of metal. Another obvious situation would be where two different alloying materials are to be added to the base metal. Because of the high currents required and because the alloying addition must be a specially processed form, the process of the present invention is most highly suited for the production of alloys in which the final concentration of the alloying element, added by the process of the present invention, is less than 10%. An inherent advantage of the present invention is that it eliminates the necessity for most master alloys thereby making possible considerable economic savings.

Another outstanding advantage of the present invention is that it makes possible a rapid change in casting composition. For example, many distinct grades of aluminum alloys vary only slightly from one another in one or two elements. Through the use of the present invention it would be possible to provide a casting furnace containing an alloy having a low alloying element content and it would be possible to cast a variety of different alloys from the same furnace by varying the alloying element concentration of the base metal between the furnace and the casting mold.

Although it is desirable to make alloying additions used in the present invention in a solid configuration, it is possible to add powdered materials or brittle materials by encasing them in a hollow tube composed of a suitable metal and then swaging or otherwise working this composite to reduce its diameter and to compact the material in the tube.

The present invention will be made more understandable through consideration of the following illustrative example.

EXAMPLE 1

The process of the present invention was used to add copper to an aluminum alloy. It was desired to add 0.15% copper to the furnace composition. The metal from the furnace, a dilute aluminum alloy flowed from the furnace through a trough of about 50 lb. capacity. The trough emptied into a tundish which held about 100 lbs. of aluminum. The tundish emptied into the mold and a solid bar of 1.53 in. diameter emerged from the mold at a rate of 60 in./min. The copper addition was fed into the trough in the form of wire having a diameter of 0.032 inch. Melting of the wire was achieved through the use of an arc at a voltage of 16 to 17 volts and a current of 180 amperes, corresponding to a current density of about 224,000 amperes per square inch. The return wire to the current source was attached to a graphite rod which was immersed in the trough. Argon was used as a shield gas at a flow rate of 25 cu.ft./hr.

The addition of copper which was melted into the trough successfully raised the copper content of the alloy from a level of 0.10% copper in the furnace to 0.23 ±0.01% copper throughout 500 ft. of cast bar. Metallographic examination indicated that the copper had been completely dissolved and was uniformly distributed through the cross-section of the bar.

This invention may be embodied in other forms or carried out in other ways without departing from the spirit or essential characteristics thereof. The present embodiment is therefore to be considered as in all respects illustrative and not restrictive, the scope of the invention being indicated by the appended claims and changes which come within the meaning and range of equivalency are intended to be embraced therein.

What is claimed is:

1. A process for adding alloying material to molten metal comprising the steps of:

A. providing the molten metal having an upper surface within a container;

B. providing the alloying material in the form of an elongated element having a free end;

C. placing the said alloying element end in close proximity to, but spaced from, the surface of the molten metal;

D. establishing an electrical potential of about 15 to 30 volts between the molten metal surface and the alloying element, to form an electric arc between the alloying element and the molten metal at a current density in excess of 100,000 amperes per square inch of cross-sectional area of the alloying element; and E. advancing the said alloying element toward the said surface to maintain the said arc, whereby, the alloying element is converted to a spray of molten particles having a size less than about 100 microns which are driven through the arc into the molten metal and uniformly distributed therein.

2. A process as in claim 1 wherein said molten metal is maintained in motion relative to said arc.

3. A process as in claim 1 wherein the alloying element is supplied in the form of wire.

4. A process as in claim 1 wherein the molten metal comprises aluminum.

5. A process as in claim 1 wherein said arc is shielded from the atmosphere by a non-reactive gas.

6. A process as in claim 1 wherein said arc is shielded from the atmosphere by a non-gaseous flux, said flux floating on the surface of the molten metal.

7. A process as in claim 1 wherein said arc is formed by a direct electrical current source.

8. A process as in claim 1 wherein the alloying element is electrically positive with respect to the molten metal.

9. A process as in claim 1 wherein the alloying element comprises copper.

10. A process as in claim 1 wherein said arc is formed by an alternating current.

11. A process as in claim 1 wherein said arc is stabilized by an alternating current component having a frequency of from 5 to 40 KHz.

* * * * *